US006695422B1

(12) United States Patent
Otsuki

(10) Patent No.: US 6,695,422 B1
(45) Date of Patent: Feb. 24, 2004

(54) POSITIONAL DIFFERENCE ADJUSTMENT DURING PRINTING WITH MULTIPLE TYPES OF DRIVE SIGNALS

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/869,964

(22) PCT Filed: Nov. 14, 2000

(86) PCT No.: PCT/JP00/08030

§ 371 (c)(1),
(2), (4) Date: Jul. 10, 2001

(87) PCT Pub. No.: WO01/36200

PCT Pub. Date: May 25, 2001

(30) Foreign Application Priority Data

Nov. 16, 1999 (JP) ..... 11-324912

(51) Int. Cl.[7] ..... B41J 2/01

(52) U.S. Cl. ..... 347/9; 347/14; 347/15; 347/19

(58) Field of Search ..... 347/9, 10, 14, 347/19, 37, 40, 15

(56) References Cited

U.S. PATENT DOCUMENTS

| | | | | |
|---|---|---|---|---|
| 4,198,642 A | | 4/1980 | Gamblin | |
| 4,686,539 A | * | 8/1987 | Schmidle et al. | 347/15 |
| 5,124,716 A | * | 6/1992 | Roy et al. | 347/11 |

FOREIGN PATENT DOCUMENTS

| | | | |
|---|---|---|---|
| EP | 827838 A2 | * | 3/1998 |
| EP | 0 827 838 | | 3/1998 |
| EP | 0 931 664 A | | 7/1999 |
| EP | 0 982 139 A | | 3/2000 |
| JP | 63-130352 A | * | 6/1988 |
| JP | 63-130352 | | 6/1988 |
| JP | 1-226342 | | 9/1989 |
| JP | 1-226342 A | * | 9/1989 |
| JP | 3-207665 | | 9/1991 |
| JP | 7-25101 | | 1/1995 |
| JP | 7-25101 A | * | 1/1995 |
| JP | 7-242025 | | 9/1995 |
| JP | 2847916 | | 2/1997 |
| JP | 10-193587 | | 7/1998 |
| JP | 10-193587 A | * | 7/1998 |
| JP | 11-5343 A | * | 1/1999 |
| JP | 11-5343 | | 1/1999 |
| WO | WO 99 52712 A | | 10/1999 |

OTHER PUBLICATIONS

Patent Abstracts of Japan, vol. 2000, No. 03, Mar. 30, 2000 & JP 11 334055 A (Seiko Epson Corp.). 7 Dec. 7, 1999.
Patent Abstracts of Japan, vol. 1998, No. 09, Jul. 31, 1998, & JP 10 109433 A (Seiko Epson Corp.), Apr. 28, 1998.

* cited by examiner

*Primary Examiner*—Stephen D. Meier
*Assistant Examiner*—Lam Nguyen
(74) *Attorney, Agent, or Firm*—Oblon, Spivak, McClelland, Maier & Neustadt, P.C.

(57) ABSTRACT

Any of n types (where n is an integer of 2 or greater) of common drive signals are selectively generated for each main scan. Drive signals to be applied to discharge drive elements are generated through reshaping the common drive signal thus selected for each pixel in accordance with print signals. Recording positions in the main scanning direction are adjusted by employing positional difference adjustment values prepared in advance in order to reduce the difference between the recording positions in the main scanning direction for combinations that are usable within the print medium of one page and that are selected from all possible combinations of common drive signals suitable for use during a forward main scanning pass and common drive signals suitable for use during a reverse main scanning pass.

12 Claims, 16 Drawing Sheets

DRIVE SIGNAL WAVEFORM FOR MULTI-SHOT DOTS

DRIVE SIGNAL WAVEFORM FOR VARIABLE DOTS

MULTI-SHOT DOTS

VARIABLE DOTS

COMBINED USE OF MULTI-SHOT DOTS AND VARIABLE DOTS

FIRST WORKING EXAMPLE OF COMBINATIONS OF COMMON DRIVE SIGNALS, AND POSITIONAL DIFFERENCE ADJUSTMENT VALUES

*Fig.8(A)*

Bi-1

| Forward | Reverse | Need for positional difference adjustment | Y/N | Adjustment value |
|---|---|---|---|---|
| MSD | VD | ○ | ○ | ΔBi(M/V) |

MSD : Multi-shot dot
VD : Variable dot

Pattern TP1

*Fig.8(B)*

Bi-2

| Forward | Reverse | Need for positional difference adjustment | Y/N | Adjustment value |
|---|---|---|---|---|
| VD | MSD | ○ | ○ | ΔBi(V/M) |

Pattern TP2

*Fig.8(C)*

Bi-3

| Forward | Reverse | Need for positional difference adjustment | Y/N | Adjustment value |
|---|---|---|---|---|
| MSD | MSD | ○ | × | — |

*Fig.8(D)*

Bi-4

| Forward | Reverse | Need for positional difference adjustment | Y/N | Adjustment value |
|---|---|---|---|---|
| VD | VD | ○ | × | — |

*Fig.8(E)*

Uni-1

| Forward | Reverse | Need for positional difference adjustment | Y/N | Adjustment value |
|---|---|---|---|---|
| MSD | | ○ | ○ | ΔUni(M/V) |
| VD | | | | |

Pattern TP3

*Fig.8(F)*

Uni-2

| Forward | Reverse | Need for positional difference adjustment | Y/N | Adjustment value |
|---|---|---|---|---|
| MSD | | × | ○ | – |

*Fig.8(G)*

Uni-3

| Forward | Reverse | Need for positional difference adjustment | Y/N | Adjustment value |
|---|---|---|---|---|
| VD | | × | ○ | – |

Test pattern TP1

Test pattern TP2

Test pattern TP3

SECOND WORKING EXAMPLE OF COMBINATIONS OF COMMON DRIVE SIGNALS, AND POSITIONAL DIFFERENCE ADJUSTMENT VALUES

*Fig. 10(A)*

Bi-1

| Forward | Reverse | Need for positional difference adjustment | Y/N | Adjustment value |
|---|---|---|---|---|
| MSD | VD | ○ | ○ | Δ Bi(M/V) |

MS : Multi-shot dot
VSD : Variable dot

Pattern TP1

*Fig. 10(B)*

Bi-2

| Forward | Reverse | Need for positional difference adjustment | Y/N | Adjustment value |
|---|---|---|---|---|
| VD | MSD | ○ | ○ | Δ Bi(V/M) |

Pattern TP2

*Fig. 10(C)*

Bi-3

| Forward | Reverse | Need for positional difference adjustment | Y/N | Adjustment value |
|---|---|---|---|---|
| MSD | MSD | ○ | ○ | Δ Bi(M/M) |

Δ Bi(M/M)= Δ Bi(V/M) + Δ Uni(M/V)

*Fig. 10(D)*

Bi-4

| Forward | Reverse | Need for positional difference adjustment | Y/N | Adjustment value |
|---|---|---|---|---|
| VD | VD | ○ | ○ | Δ Bi(V/V) |

Δ Bi(V/V)= Δ Bi(M/V) − Δ Uni(M/V)

*Fig. 10(E)*

Uni-1

| Forward | Reverse | Need for positional difference adjustment | Y/N | Adjustment value |
|---|---|---|---|---|
| MSD | | ○ | ○ | Δ Uni(M/V) |
| VD | | | | |

Pattern TP3

*Fig. 10(F)*

Uni-2

| Forward | Reverse | Need for positional difference adjustment | Y/N | Adjustment value |
|---|---|---|---|---|
| MSD | | × | ○ | − |

*Fig. 10(G)*

Uni-3

| Forward | Reverse | Need for positional difference adjustment | Y/N | Adjustment value |
|---|---|---|---|---|
| VD | | × | ○ | − |

Fig.14(a) LD
Δ1
Δ0
Fig.14(b) COMDRV
Fig.14(c) CLK2
Fig.14(d) CLK1
n0
n1

POSITIONAL DIFFERENCE ADJUSTMENT DURING PRINTING WITH MULTIPLE TYPES OF DRIVE SIGNALS

TECHNICAL FIELD

The present invention relates to a printing technology in which images are printed with discharged ink droplets.

BACKGROUND OF THE INVENTION

Ink-jet printers in which ink is discharged from a head are currently being used on a wide scale as computer output devices. In conventional ink-jet printers, each pixel can be reproduced with two values ("on" and "off"), and multiple-value printers capable of expressing three or more values with a single pixel have recently been proposed. Multiple-value pixels can, for example, be reproduced by adjusting the size of the dots formed at each pixel position. An arrangement should preferably be adopted in which a plurality of types of drive signals having various waveforms can be fed to the print head in order to be able to form dots having maximum diversity.

However, the recording positions of dots in the main scanning direction do not necessarily coincide when different types of drive signals are used to print a single page, and image quality may be adversely affected accordingly. This problem is not limited to the reproduction of multiple-value pixels and is common to other cases in which a multiple types of drive signals are used within a single page.

An object of the present invention, which was perfected in order to address the above-described problems of the prior art, is to provide a technique that reduces the difference in the recording positions of dots in the main scanning direction when a plurality of types of drive signals are used within a single page.

SUMMARY OF THE INVENTION

In order to solve at least part of the above problems, the present invention performs printing with a printing device including: a print head having a plurality of nozzles and a plurality of discharge drive elements for causing the plurality of nozzles to discharge ink droplets from; and a head drive for reshaping a common drive signal in accordance with print signals and supplying drive signals to the discharge drive elements. One of n types of common drive signals is selectively generated for each main scan where n is an integer of 2 or greater. The selected common drive signal is reshaped in accordance with the print signals with respect to each pixel, thereby generating the drive signals to be supplied to the discharge drive elements. Recording positions in the main scanning direction are adjusted with positional difference adjustment values prepared in advance in order to reduce a difference between the recording positions in the main scanning direction, where the positional difference adjustment values are prepared for combinations of common drive signals that are usable within one page of the print medium and that are selected from all possible combinations of common drive signals suitable for use in a forward main scanning pass and common drive signals suitable for use in a reverse main scanning pass.

In this structure, each of the combinations usable within one page of the print medium is adjusted using positional difference adjustment values prepared in advance, making it possible to reduce the difference between the recording positions of dots in the main scanning direction even when multiple types of drive signals are used within one page.

As used above, the phrase "common drive signals suitable for use during a forward main scanning pass, and common drive signals suitable for use during a reverse main scanning pass" is not necessarily premised on performing bi-directional printing and can also be applied to unidirectional printing. In the case of unidirectional printing, this will correspond, for example, to the absence of the portion "common drive signals suitable for use during a reverse main scanning pass."

The positional difference adjustment values include bi-directional adjustment values for use during bi-directional printing and/or unidirectional adjustment values for use during unidirectional printing. With this arrangement, the corresponding differences between recording positions can be adjusted in accordance with bi-directional printing, unidirectional printing, or any other printing technique acceptable for use within one page.

When the main scan is performed using at least one specific common drive signal selected from n types of common drive signals, a main scan may be carried out at a main scan speed different from the speed at which the main scan is performed using other common drive signals.

Recording positions can thus be adjusted highly efficiently because positional differences tend to occur particularly readily in the main scanning direction when different main scan speeds are involved.

The print head may be capable of forming multiple types of dots of different sizes on a print medium with the aid of nozzles, and the print signals may be signals with a plurality of bits per pixel that are used for recording each pixel with multi tones. In this case, each of the n types of common drive signals generates a plurality of pulses during a single pixel period, and the drive signals are generated by the reshaping of the common drive signal in accordance with the multi-bit print signals.

In particular, various common drive signals are highly likely to be used in print heads capable of forming dots having different sizes. Consequently, the present invention is particularly effective for reducing the differences in the recording positions of dots in the main scanning direction under such conditions.

The present invention can be implemented as a variety of embodiments, examples of which include printing methods, printing devices, print control methods, print control devices, computer programs for performing the functions of these methods or devices, recording media for storing these computer programs, and data signals embodied in a carrier wave containing these computer programs.

BRIEF DESCRIPTION OF THE DRAWINGS

FIGS. 8(A)–8(G) show a first working example of the combinations of dot series used for printing;

FIGS. 10(A)–10(G) show a second working example of the combinations of dot series used for printing;

PREFERRED EMBODIMENTS OF THE INVENTION

Embodiments of the present invention will now be described through working examples in the following order.

A. Overall Device Structure

B. Multiple Types of Common Drive Signals

C. Combinations of Dot Series, and Positional Difference Adjustment During Recording D. Internal Structure of Head Drive Circuit 52

F. Modifications

A. Device Structure

Figure 1:
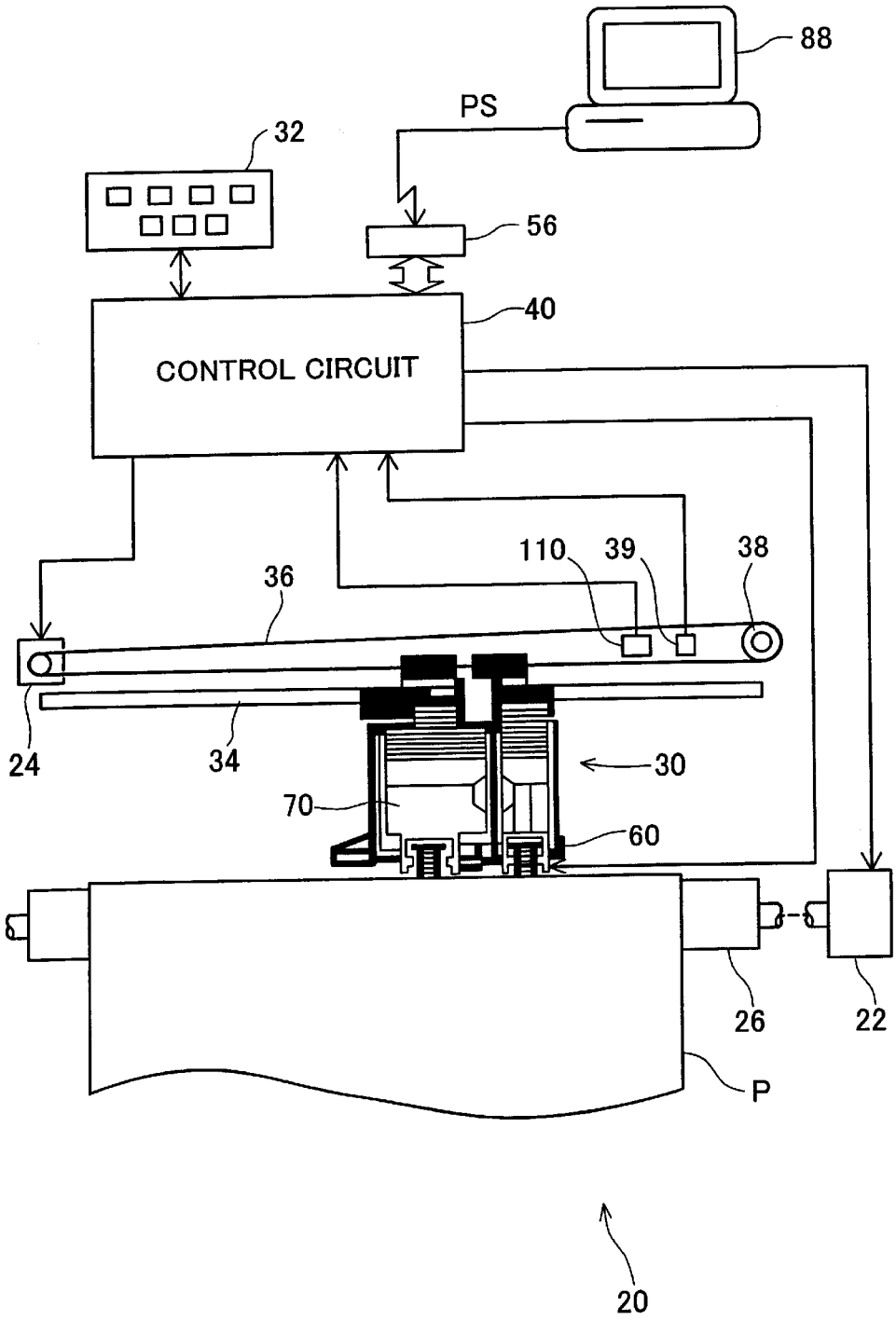
FIG. 1 is a schematic block diagram of a printing system equipped with a printer 20 according to a working example.

FIG. 1 is a schematic block diagram of a printing system equipped with an ink-jet printer 20 as a working example of the present invention. The printer 20 comprises a sub-scan feed mechanism for transporting printing paper P in the sub-scanning direction by a paper feed motor 22; a main scan feed mechanism for reciprocating a carriage 30 by a carriage motor 24 in the axial direction (main scanning direction) of a platen 26; a head drive mechanism for actuating a print head unit 60 (also referred to as "a print head assembly") mounted on the carriage 30 and controlling the ink discharge and dot formation; and a control circuit 40 for controlling the signal transmission between a control panel 32 and the paper feed motor 22, carriage motor 24, and print head unit 60. The control circuit 40 is connected by a connector 56 to a computer 88.

The sub-scan feed mechanism for transporting printing paper P comprises a gear train (not shown) for transmitting the rotation of the paper feed motor 22 to the platen 26 and to a paper feed roller (not shown). The main scan feed mechanism for reciprocating the carriage 30 comprises a sliding shaft 34 disposed parallel to the axis of the platen 26 and designed to slidably hold the carriage 30, a pulley 38 for extending an endless drive belt 36 all the way to the carriage motor 24, and a position sensor 39 for detecting the initial position of the carriage 30.

Figure 2:
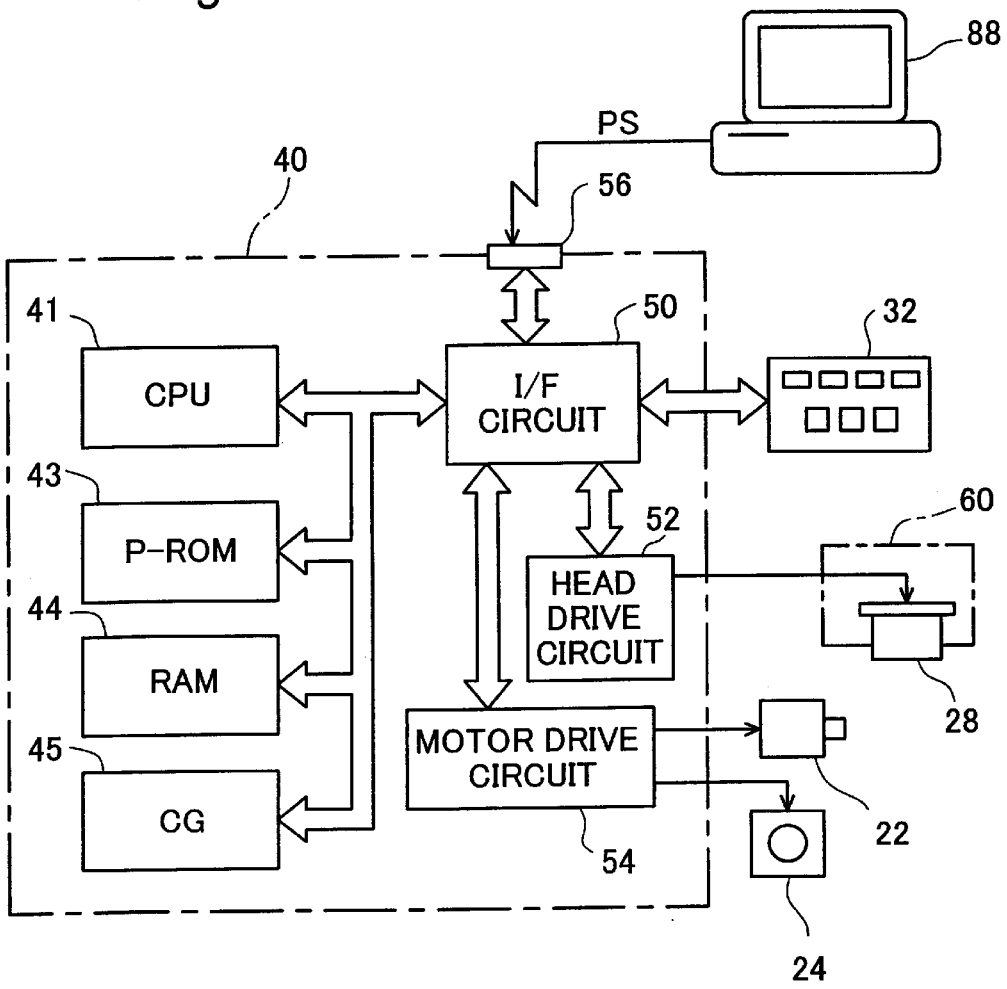
FIG. 2 is a block diagram depicting the structure of the control circuit 40 in the printer 20.

FIG. 2 is a block diagram depicting the structure of the printer 20 having the control circuit 40. The control circuit 40 is configured as an arithmetic logic operating circuit comprising a CPU 41, a programmable ROM (PROM) 43, a RAM 44, and a character generator (CG) 45 containing character dot matrices. The control circuit 40 further comprises an I/F dedicated circuit 50 for forming a dedicated interface with external motors and the like; a head drive circuit 52 connected to the I/F dedicated circuit 50 and designed to drive the print head unit 60 to discharge the ink; and a motor drive circuit 54 for actuating the paper feed motor 22 and carriage motor 24. The I/F dedicated circuit 50 contains a parallel interface circuit and can receive the print signals PS fed from the computer 88 via the connector 56. The print signals (print data) PS include data representing sub-scan feed amounts and raster data representing the recording states of dots during each main scan. The printer 20 prints images in accordance with the print signals PS.

The print head unit 60 has a print head 28 and allows an ink cartridge to be mounted. The print head unit 60 is mounted as a single component on the printer 20. Specifically, the entire print head unit 60 is replaced in order to replace the print head 28.

Figure 3:
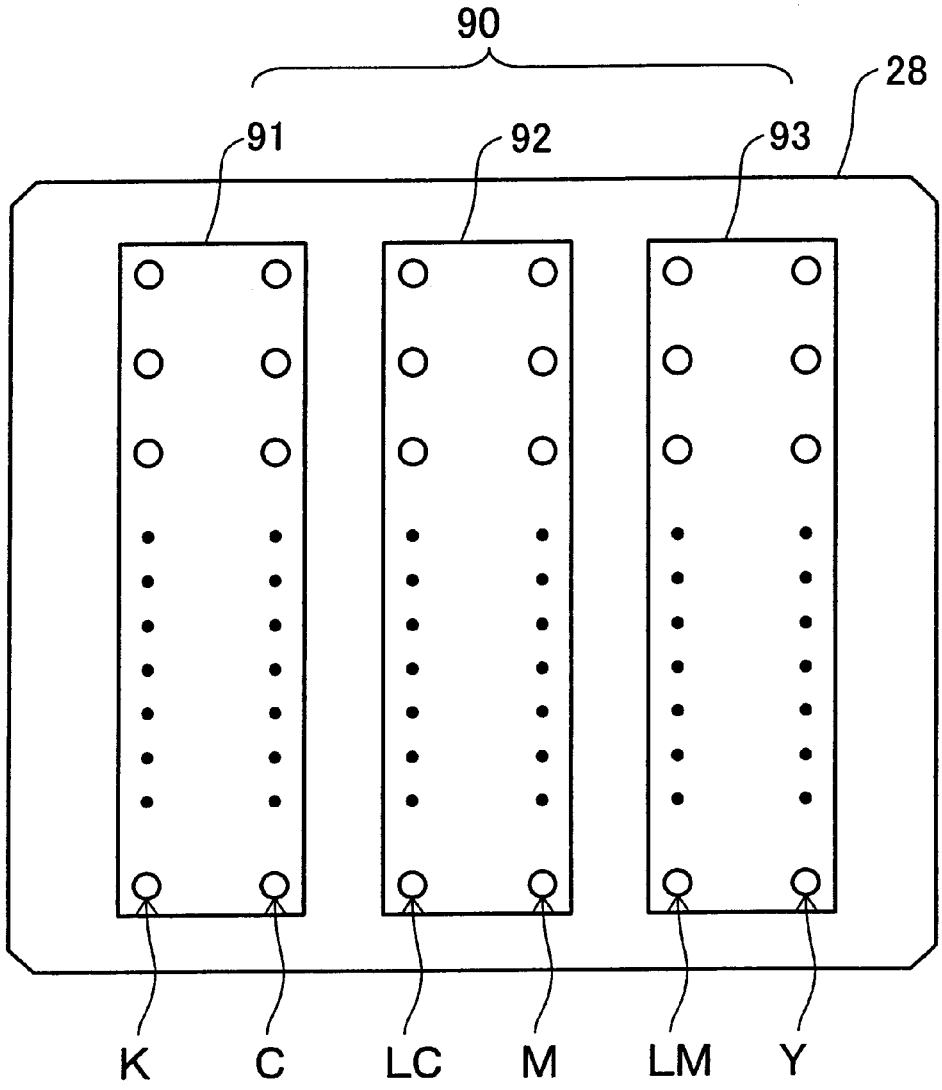
FIG. 3 is a diagram depicting a plurality of actuator chips and a plurality of nozzle rows in the print head 28.

FIG. 3 is a diagram depicting a plurality of actuator chips and a plurality of nozzle rows on the print head 28. The printer 20 is a printing device for printing images with inks of the following six colors: black (K), dark cyan (C), light cyan (LC), dark magenta (M), light magenta (LC), and yellow (Y). A nozzle row is provided for each type of ink. Dark cyan and light cyan are cyan inks having substantially the same hue but different concentrations. The same holds true for the dark magenta ink and light magenta ink.

In the drawing, the actuator circuit 90 comprises a first actuator chip 91 for actuating a black nozzle row K and a dark cyan nozzle row C, a second actuator chip 92 for actuating a light cyan nozzle row LC and a dark magenta nozzle row M, and a third actuator chip 93 for actuating a light magenta nozzle row LM and a yellow nozzle row Y.

A piezoelectric element (not shown) is provided to each nozzle of the actuator chips 91–93. A drive signal is fed to each piezoelectric element from the head drive circuit 52, and the piezoelectric elements discharge ink droplets from the nozzles in accordance with these drive signals. Drive elements (heaters or the like) other than piezoelectric elements may also be used.

B. Multiple Types of Common Drive Signals

Figure 4:
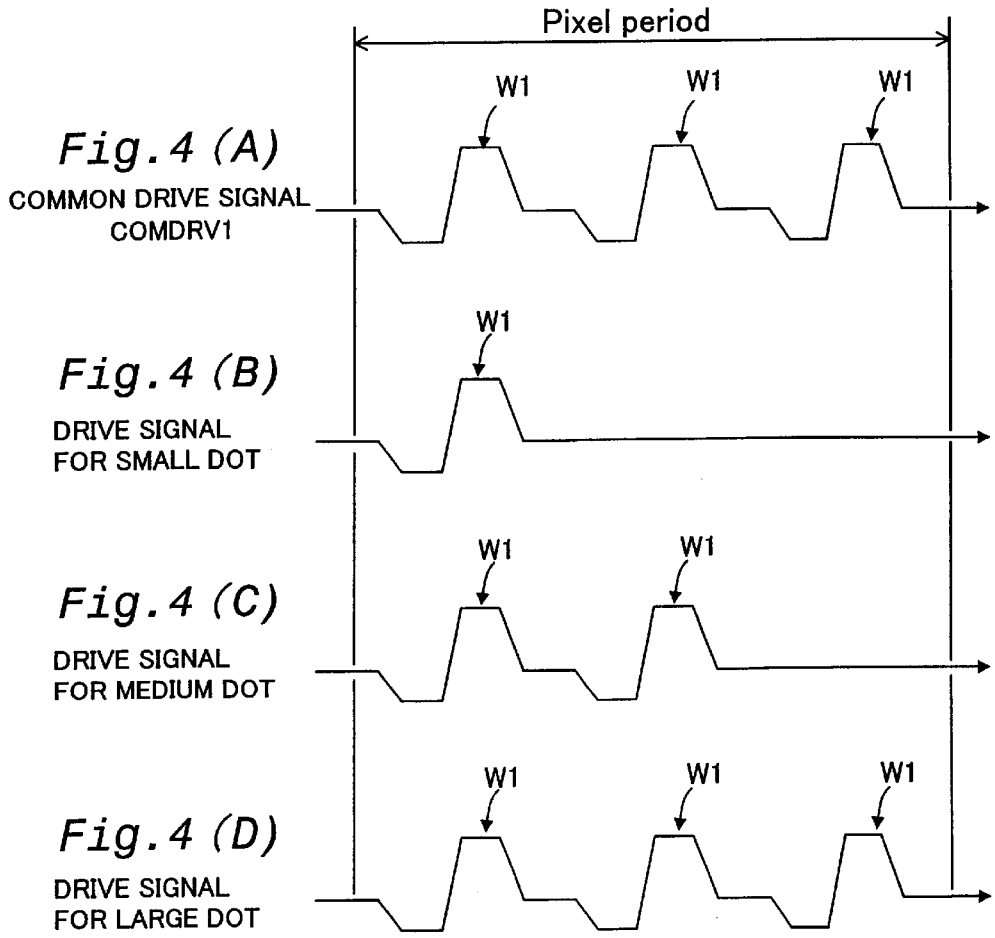
FIGS. 4(A)–4(D) are timing charts depicting a drive signal waveform for multi-shot dots.

FIGS. 4(A)–4(D) are timing charts depicting a first drive signal waveform used in the present embodiment. As shown in FIG. 4(A), the first common drive signal COMDRV1 generates three identical pulses W1 within a single pixel interval. The common drive signal COMDRV1 is used such that only the first pulse is retained and the other pulses are masked when a small dot is recorded, the first and second pulses are retained and the third pulse is masked when a medium dot is recorded, and the signal is used unchanged without any masking when a large dot is recorded, as shown in FIGS. 4(B), 4(C), and 4(D), respectively. Any of the three types of dots having different sizes can thus be selectively recorded at each pixel position as a result of the masking in accordance with a serial print signal that represents a dot formation state at each pixel. The three types of dots formed with the first drive signal waveform will be referred to hereinbelow as "multi-shot dots."

Figure 5:
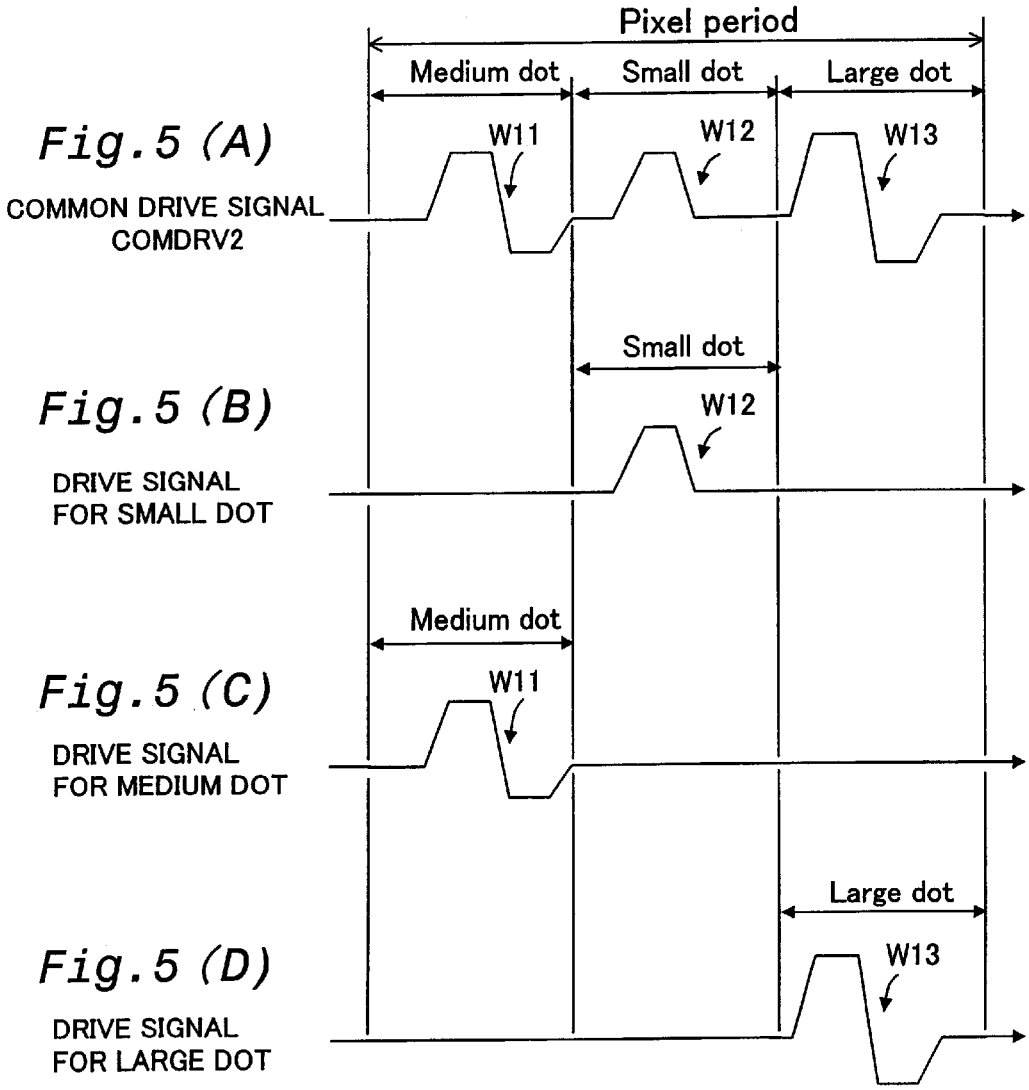
FIGS. 5(A)–5(D) are timing charts depicting a drive signal waveform for variable dots.

FIGS. 5(A)–5(D) are timing charts depicting a second drive signal waveform used in the present embodiment. As shown in FIG. 5(A), a second common drive signal COMDRV2 is provided such that each pixel interval is divided into three partial intervals, and three pulses W11, W12, and W13 having different waveforms are generated within each interval. Only the second pulse W12 is retained and the other pulses are masked when a small dot is recorded, only the first pulse W11 is retained and the other pulses are masked when a medium dot is recorded, and only the third pulse W13 is retained and the other pulses are masked when a large dot is recorded, as shown in FIGS. 5(B), 5(C), and 5(D), respectively. In this case as well, any of three types of dots having different sizes can be selectively recorded at each pixel position as a result of the masking in accordance with a serial print signal that represents a dot formation state at each pixel. The three types of dots formed with the second drive signal waveform will be referred to hereinbelow as "variable dots."

It is also possible to use common drive signals whose waveforms are different from the two types described above. The structure of a circuit for generating common drive signals having various desired waveforms will be described later in detail, and so will be the structure of a circuit for masking the common drive signals.

Figure 6:
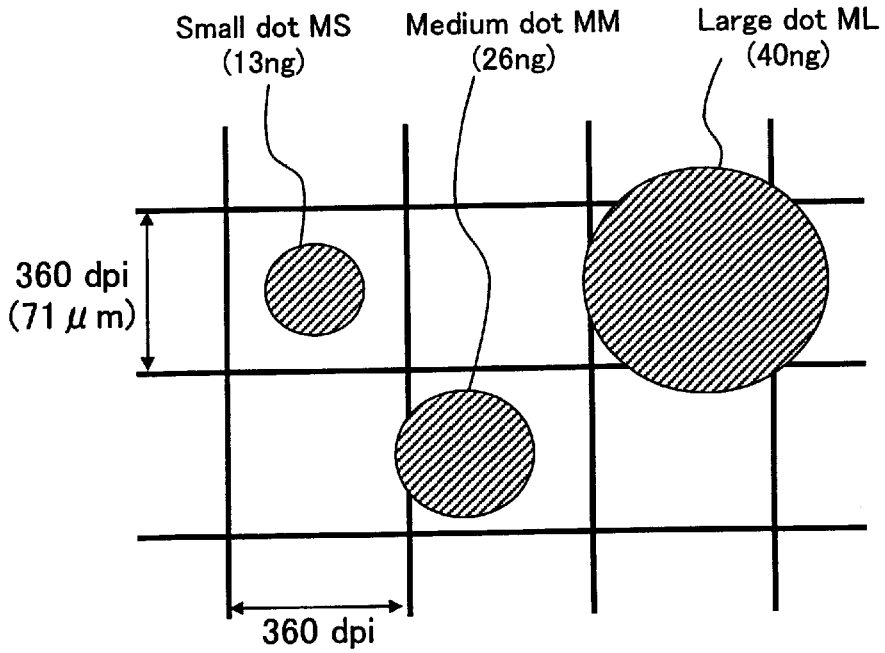
FIGS. 6(A) and 6(B) illustrate a comparison between the shapes of multi-shot dots and variable dots.
Figure 6:
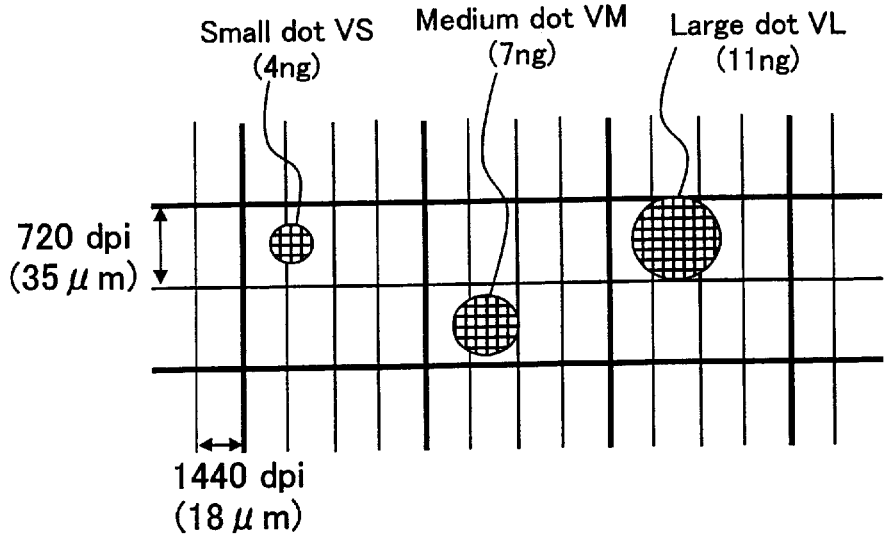

FIGS. 6(A) and 6(B) illustrate a comparison between the shapes of multi-shot dots and variable dots. As can be seen in FIG. 6(A), the small dot MS in a group of multi-shot dots is formed by a 13-ng ink droplet, the medium dot MM is formed by a 26-ng ink droplet, and the large dot ML is formed by a 40-ng ink droplet. Using these three types of multi-shot dots MS, MM, and ML alone will make it possible to rapidly print images at a comparatively low printing resolution, that is, at 360 dpi both in the main scanning direction and in the sub-scanning direction. The printing resolution obtained in this manner by employing a single type of drive signal waveform will be referred to hereinbelow as "sole-use resolution." "Printing resolution" and "recording resolution" will also be used herein as synonyms.

As can be seen in FIG. 6(B), the small dot VS in a group of variable dots is formed by a 4-ng ink droplet, the medium dot VM is formed by a 7-ng ink droplet, and the large dot VL is formed by an 11-ng ink droplet. The sole-use printing resolution of the variable dots is 1440 dpi in the main scanning direction and 720 dpi in the sub-scanning direction. Variable dots are superior to multi-shot dots in the sense that high-quality images can be printed with higher resolution. Even when images are printed by the sole use of variable dots, it is difficult to record dots at a resolution of 1440 dpi in the main scanning direction by a single main scan. In view of this, actual dot recording on a single raster line is sometimes completed in four main scans. In the process, dot recording on each raster line is completed by a method in which the dots are recorded at a rate of one in four pixels on each raster line in a single main scan such that all the dots are ultimately recorded in a mutually complementary manner in four main scans. Consequently, variable dots can be printed at a higher resolution than multi-shot dots, albeit at a lower printing speed.

The term "series of multi-shot dots" will be used hereinbelow to collectively refer to the three multi-shot dots MS, MM, and ML, and the term "series of variable dots" will be used to collectively refer to the three variable dots VS, VM, and VL.

Figure 7:
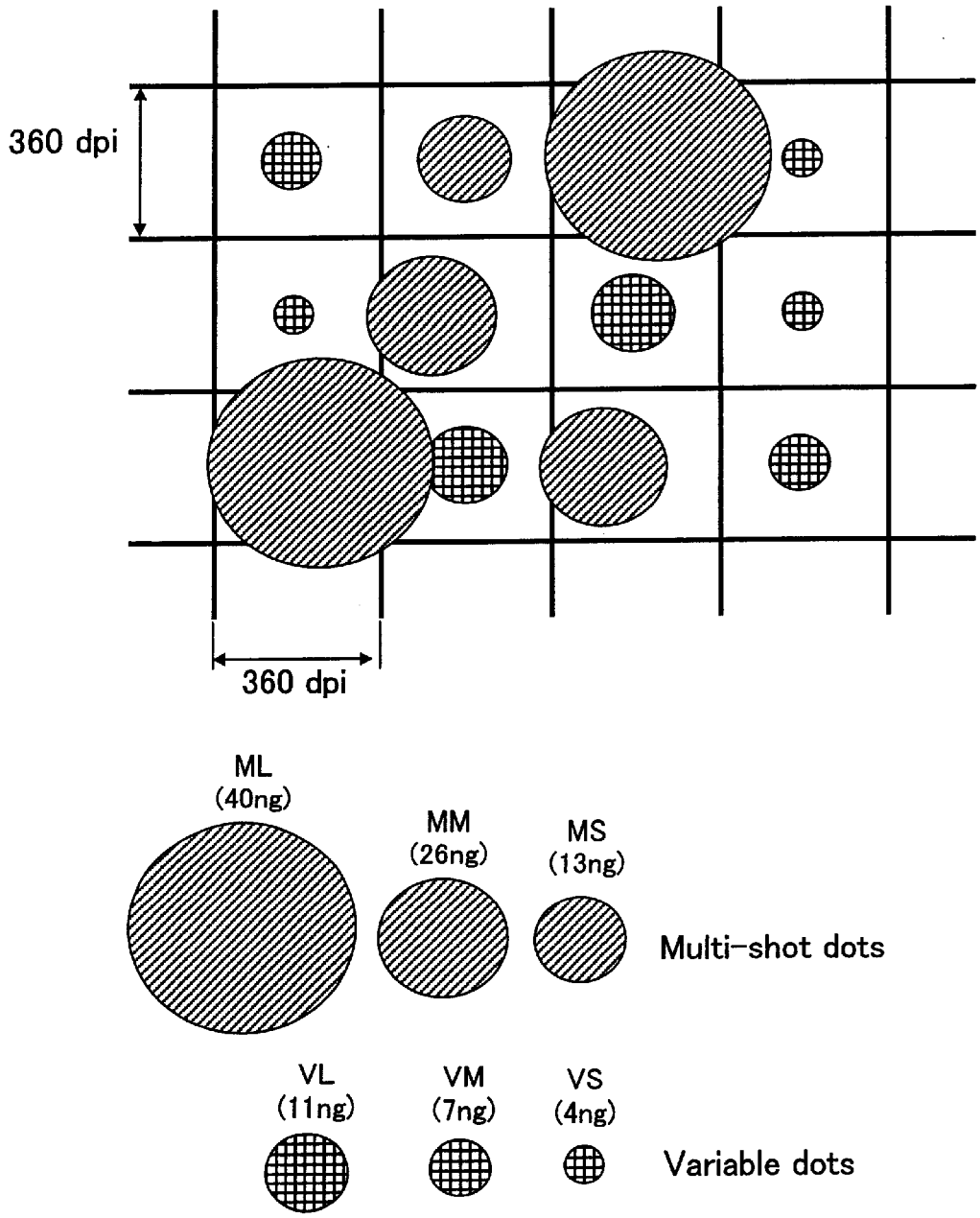
FIG. 7 is a diagram depicting an example in which images are printed using both multi-shot dots and variable dots.

FIG. 7 is a diagram depicting an example in which images are printed by the combined use of a series of multi-shot dots and a series of variable dots. When images are printed by the combined use of the two dot series, the lower of the two sole-use printing resolutions (that is, the printing resolution provided by the series of multi-shot dots) is adopted as the print resolution in the sub-scanning direction.

The series of multi-shot dots and the series of variable dots can be superposed on each raster line when the two dot series are used together. Specifically, all the pixel positions on a raster line will be the target of dot formation when a series of multi-shot dots are used for this raster line, and also when a series of variable dots are used for the same raster line. In practice, however, image density can be reproduced less consistently when two or more dots are superposed at the same pixel position. Consequently, image processing by the printer driver in the computer 88 is preferably performed such that only one of these dots is recorded at a single pixel position. As will become apparent from the description, the term "superposition" is not limited to cases in which two or more dots are actually recorded at the same pixel position, and is expanded to include cases in which the same pixel positions are targeted for recording. The term "a pixel position is targeted for recording" refers to cases in which the pixel position is brought to a state in which a dot can be recorded by actuating a drive element.

Images can be printed using dots of six different sizes by superposing series of multi-shot dots and series of variable dots on each raster line. In this case, the tendency is to use relatively many series of multi-shot dots in high-density image areas, and relatively many series of variable dots in low-density image areas. As a result, dot graininess can be reduced in low-density image areas substantially in the same manner as when series of variable dots are used alone. Thus, combining the use of two dot series can improve image quality in comparison with the sole use of series of multi-shot dots because images can be reproduced with dots having six different sizes.

The small dot MS of a series of multi-shot dots is 13 ng of ink, and the large dot VL of a series of variable dots is 11 ng of ink, indicating that the two can be formed with substantially the same amount of ink. The gray scale can thus be expressed more smoothly during printing with combinations of two types of dot series if an approach is adopted in which the largest dot of the smaller dot series and the smallest dot of the larger dot series have substantially the same size when the two different types of dot series are used.

The main scan speed (carriage speed) for recording a series of variable dots is set below the main scan speed for recording a series of multi-shot dots. The reason is that the waveform of the common drive signal COMDRV2 for variable dots (FIG. 5(A)) is more complicated than the common drive signal COMDRV1 for multi-shot dots (FIG. 4(A)), so more time is needed to form a single pixel interval of the corresponding drive waveform. For example, the main scan speed for recording a series of variable dots is about 200 cps (characters per second), and the main scan speed for recording a series of multi-shot dots is about 250 cps. When two dot series-are used together, the mean main scan speed is about 225 cps, which is less than the speed maintained when a series of multi-shot dots is used alone. The printing speed is therefore somewhat reduced in proportion to this.

However, the sub-scanning resolution is 720 dpi when a series of variable dots are used alone, as described above. In addition, dot recording along each raster line is completed in four main scans, resulting in a fairly low printing speed. By contrast, combining the use of two dot series makes the sub-scanning resolution 360 dpi, and because dots can be completely recorded in two main scans for each raster line, the printing speed is almost as high as that achieved when a series of multi-shot dots are used alone. In addition, an image quality close to that obtained when a series of variable dots are used alone can be achieved for low-density image areas. Consequently, combining the use of two dot series makes it possible to simultaneously achieve a high printing speed close to that obtained when series of multi-shot dots are used alone and to provide an improved image quality close that obtained when series of variable dots are used alone.

C. Combinations of Dot Series, and Positional Difference Adjustment During Recording FIGS. 8(A)–8(G) show a first working example of the combinations of dot series used for printing. FIGS. 8(A) to 8(D) depict combinations acceptable for bi-directional printing. In the first combination Bi-1 shown in FIG. 8(A), a series of multi-shot dots are used on the forward pass, and a series of variable dots are used on the reverse pass. Conversely, in the second combination Bi-2 shown in FIG. 8(B), a series of variable dots are used on the forward pass, and a series of multi-shot dots are used on the reverse pass. In the third combination Bi-3 shown in FIG. 8(C), a series of multi-shot dots are used for both the forward and reverse passes. In the fourth combination Bi-4 shown in FIG. 8(D), a series of variable dots are used for both the forward and reverse passes. The difference between the positions of the two dot series is adjusted for all these combinations during bi-directional printing.

FIGS. 8(E) to 8(G) depict combinations acceptable for unidirectional printing. The first combination Uni-1 shown in FIG. 8(E) utilizes a main scan pass using a series of multi-shot dots, and a main scan pass using a series of variable dots. A series of multi-shot dots alone are used for the second combination Uni-2 shown in FIG. 8(F), and a series of variable dots alone are used in the third combination Uni-3 shown in FIG. 8(G). In unidirectional printing, the positional difference of dot series needs to be adjusted only for the first combination Uni-1 (in which a series of multi-shot dots and a series of variable dots are used together), and no adjustment is needed for the positional difference of the dot series when a single dot series is used. However, positional difference adjustment may be performed for the dots having different sizes within the dot series in FIG. 8(F) or 8(G).

The first working example entails adopting the two combinations Bi-1 and Bi-2 of bi-directional printing shown in FIGS. 8(A) and 8(B), and the three combinations of unidirectional printing shown in FIGS. 8(E) to 8(G) while dispensing with the two combinations Bi-3 and Bi-4 of bi-directional printing shown in FIGS. 8(C) and 8(D). Specifically, the first working example can use any of the five combinations (Bi-1, 2 and Uni-1, 2, 3) in accordance with the printing mode. The two combinations adopted for bi-directional printing can be used in mixed form within a single page. It is possible, for example, to adopt the first combination Bi-1 for odd-numbered lines, and the second combination Bi-2 for even-numbered lines.

Positional difference adjustment values ΔBi (M/V), ΔBi (V/M), and ΔUni (M/V) are set, respectively, for the three combinations (Bid-D-1, 2, and Uni-1) for which such positional difference adjustment values are required, as shown in the columns on the right side of FIGS. 8(A) to 8(G).

Figure 9A:
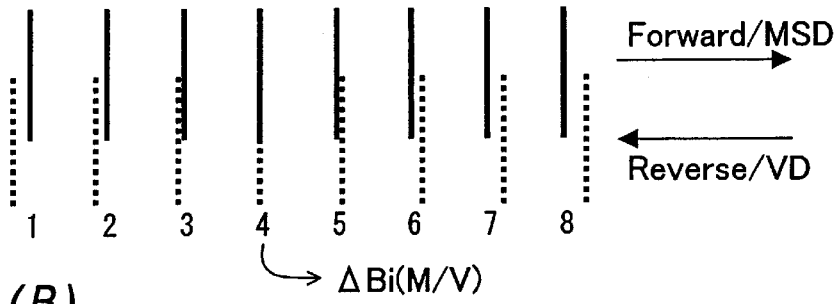
FIGS. 9(A)–9(C) show the test patterns used for positional difference adjustments in the first working example.
Figure 9B:
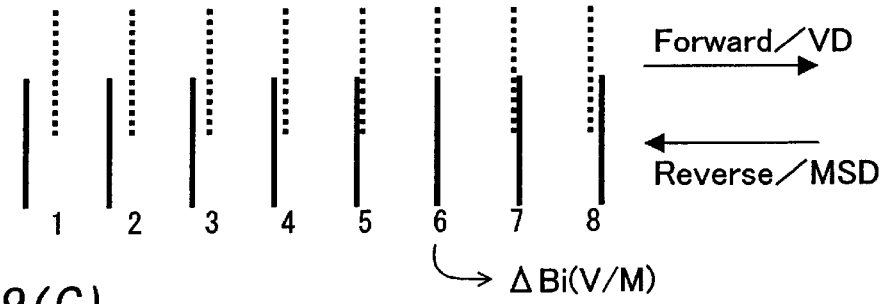
Figure 9C:
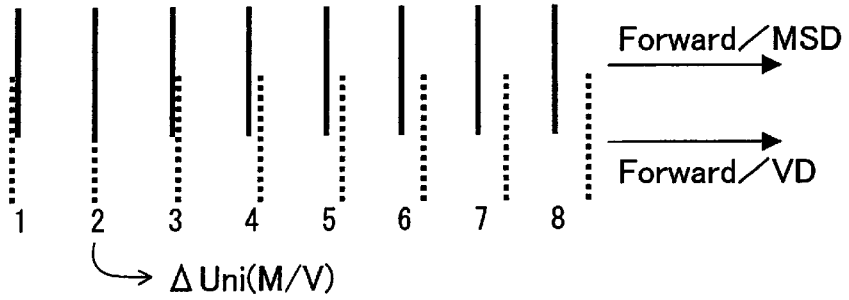

FIGS. 9(A)–9(C) show an example of test patterns for determining positional difference adjustment values. The first test pattern TP1 shown in FIG. 9(A) contains a plurality of vertical ruled line pairs. As used herein, the term "vertical ruled line" refers to a straight line extending in the sub-scanning direction. The multiple vertical ruled line pairs comprise a plurality of vertical ruled lines printed at regular intervals during an forward pass, and a plurality of vertical ruled lines printed at regular intervals during a reverse pass. The interval between the vertical ruled lines printed during the reverse pass is somewhat greater than the interval between the vertical ruled lines printed during the forward pass. As a result, the vertical ruled lines of the reverse pass are printed with a sequential shift in relation to the vertical ruled lines of the forward pass. In addition, the test pattern TP1 is obtained using multi-shot dots on the forward pass, and variable dots on the reverse pass. Although the vertical ruled lines formed by variable dots are shown as dotted lines for the sake of convenience, actual printing is preferably performed such that solid lines are formed.

Numerals indicating positional difference adjustment numbers are printed underneath the vertical ruled line pairs. The positional difference adjustment numbers function as the correction information indicating a preferred corrected state (adjusted state). As used herein, the term "preferred corrected state" refers to a state in which dot positions coincide with each other in the main scanning direction. In the example shown in FIG. 9(A), the vertical ruled line pair whose positional difference adjustment number is 4 indicates a preferred corrected state.

The combination of dot series in FIG. 9(A) is the same as the first combination Bi-1 for bi-directional printing shown in FIG. 8(A). The adjustment value ΔBi(M/V) expressed by a positional difference adjustment number with a value of 4 is therefore used as a positional difference adjustment value for the combination Bi-1. It is also possible to directly use the value of the positional difference adjustment number as the adjustment value ΔBi(M/V), or to use the amount of shift (distance or time) of the positional difference adjustment.

A variety of options can be adopted for the combinations of the ink used to print the vertical ruled lines of an forward pass, and the ink used to print the vertical ruled lines of a reverse passes. Specifically, the same ink (for example, black ink) may be used on the forward and reverse passes, or different inks may be used on the forward and reverse passes. For example, magenta ink may be used either on the forward pass or on the reverse pass, and cyan ink may be used on the other of the two passes in order to correct positional differences during unidirectional color printing. The positions at which dots are recorded in the main scanning direction can thus be adjusted to render positional differences of magenta dots and those for cyan dots substantially equal to each other.

In the second test pattern TP2 shown in FIG. 9(B), variable dots are used on the forward pass, and multi-shot dots are used on the reverse pass. The positional difference adjustment number indicating the preferred corrected state is 6. The combination of dot series in FIG. 9(B) corresponds to the second combination Bi-2 of bi-directional printing shown in FIG. 8(B). The adjustment value ΔBi(V/M) expressed by the positional difference adjustment number with a value of 6 is therefore used as a positional difference adjustment value for the combination Bi-2.

Both of the upper vertical ruled lines and the lower vertical ruled lines are printed on the forward passes in the third test pattern TP3 shown in FIG. 9(C). The upper vertical ruled lines are printed using multi-shot dots, and the lower vertical ruled lines are printed using variable dots. The positional difference adjustment number indicating the preferred corrected state is 2. The combination of dot series in FIG. 9(C) corresponds to the combination Uni-1 of unidirectional printing shown in FIG. 8(C). An adjustment value ΔUni(M/V) expressed by the positional difference adjustment number with a value of 6 is therefore used as the positional difference adjustment value for the combination Uni-1.

FIGS. 10(A)–10(G) show a second working example of the combinations of dot series used for printing. The second working example is almost the same as the first working example except that the first working example, which is shown in FIGS. 8(A)–8(G), is modified such that the third and fourth combinations Bi-3 and Bi-4 of bi-directional printing are adopted as the combinations acceptable for actual printing.

The positional difference adjustment value ΔBi(M/M) for the third combination Bi-3 of bi-directional printing can be determined based on the test patterns TP1–TP3 shown in FIGS. 9(A)–9(C). In the third combination Bi-3, multi-shot dots are used both on the forward pass and on the reverse pass. The test patterns TP2 and TP3 shown in FIGS. 9(B) and (C) are similar in the sense that they include vertical ruled lines formed by variable dots during the forward pass. The difference between the two patterns is that the second test pattern TP2 contains vertical ruled lines formed by multi-shot dots during a reverse pass, and the third test pattern TP3 contains vertical ruled lines formed by multi-shot dots during an forward pass. Consequently, the positional difference adjustment value ΔBi(M/M) for the third combination Bi-3 of bi-directional printing can be calculated by adding the positional difference adjustment value ΔBi(V/M) obtained from the second test pattern TP2 and the positional difference adjustment value ΔUni(M/V) obtained from the third test pattern TP3, as given by Eq. (1) below.

$$\Delta Bi(M/M)=\Delta Bi(V/M)+\Delta Uni(M/V) \quad (1)$$

By contrast, the positional difference adjustment value ΔBi(V/V) for the fourth combination Bi-4 of bi-directional printing can be calculated by subtracting the positional difference adjustment value ΔUni(M/V) obtained based on the third test pattern TP3 from the positional difference adjustment value ΔBi(V/M) obtained based on the first test pattern TP1, as given by Eq. (2) below.

$$\Delta Bi(V/V)=\Delta Bi(M/V)-\Delta Uni(M/V) \quad (2)$$

Thus, the working examples of the present invention entail preparing positional difference adjustment values in the main scanning direction for combinations that are available for use within one page of print medium and that are selected from all possible combinations of the types of dot series (that is, the types of common drive signals) suitable for use in main scanning during an forward pass, and the types of dot series suitable for use in main scanning during a reverse pass. These positional difference adjustment values are used as needed to adjust positional differences during each main scan during printing of one page.

Only the positional difference adjustment values for bi-directional printing are prepared when the combinations that can be used within one page of print medium involve bi-directional printing alone. Similarly, only the positional difference adjustment values for unidirectional printing are prepared when the combinations that can be used within one page of print medium involve unidirectional printing alone. A large number of combinations can be used to print a page if the positional difference adjustment values for both bi-directional and unidirectional printing are prepared as can be understood from the above descriptions of the first and second working examples.

Figure 11:
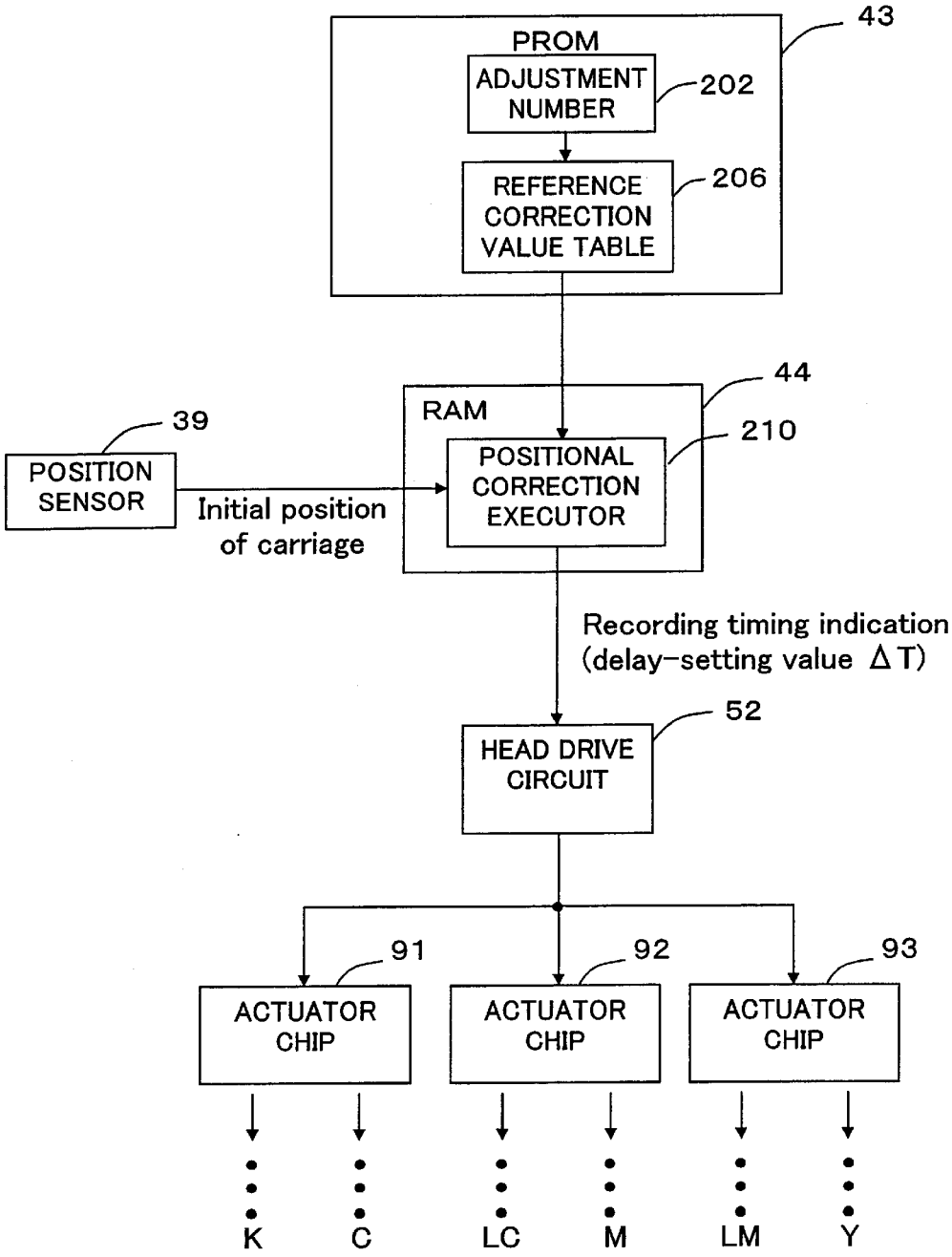
FIG. 11 is a block diagram of a main structure pertaining to the adjustment of positional differences in the main scanning direction.

FIG. 11 is a block diagram of a main structure pertaining to the adjustment of positional differences in the main scanning direction. PROM 43 in the printer 20 (FIG. 2) is provided with an adjustment number storage area 202 and a correction value table 204. The positional difference adjustment numbers for indicating preferred corrected states are stored in the adjustment number storage area 202. The correction value table 204 stores the relation between positional difference adjustment numbers and positional difference correction values (adjustment values) Δ.

RAM 44 in the printer 20 stores a computer program that functions as a positional difference correction executor (adjustment value determinator) 210 for correcting the positional difference in the main scanning direction. The positional difference correction executor 210 reads the positional difference adjustment numbers stored in the PROM 43 from the adjustment number storage area 202 in accordance with the dot series used for each main scan (that is, in accordance with the type of common drive signal), and also reads the correction value Δ corresponding to the positional difference adjustment number from the correction value table 204. Upon receipt of the signal indicating the initial position of the carriage 30 from the position sensor 39 (FIG. 1) during each main scan, the positional difference correction executor 210 feeds a signal (delay-setting value ΔT) for indicating the recording timing of the head to the head drive circuit 52 in accordance with the dot series used for these main scans. The head drive circuit 52 supplies the same drive signal to the three actuator chips 91–93 while adjusting the recording position of each main scan in accordance with the recording timing (that is, delay-setting value ΔT) provided by the positional difference correction executor 210. The recording positions of six groups of nozzle rows are thus adjusted by a common correction value for each main scan.

When one page is printed using the first combination Bi-1 of bi-directional printing shown in FIG. 8(A), the recording timing is adjusted in accordance with the adjustment value ΔBi(M/V) during a reverse pass without being adjusted during an forward passe. Similarly, the recording timing is adjusted in accordance with the adjustment value ΔBi(V/M) during the reverse pass without being adjusted during the forward pass when a page is printed using the second combination Bi-2 of bi-directional printing shown in FIG. 8(B).

A page is sometimes printed using both the first and second combinations Bi-1 and Bi-2 of bi-directional printing shown in FIGS. 8(A) and 8(B). It is possible, for example, to use the first combination Bi-1 for the central area of a print medium, and the second combination Bi-2 for the upper or lower edge of the print medium. For example, the following adjustments may be made in such cases.

(a) Forward pass with multi-shot dots: No adjustment (b) Reverse pass with variable dots: Adjustment with adjustment value ΔBi(M/V)

(c) Forward pass with variable dots: Adjustment with adjustment value ΔUni(M/V)

(d) Reverse pass with multi-shot dots: Adjustment with adjustment value [ΔBi(V/M)+ΔUni(M/V)]

These examples demonstrate that the present working examples reduce a difference between the recording positions in the main scanning direction by adjusting the recording positions during each main scan when multiple combinations of dot series types (that is, types of common drive signals) for the forward and reverse passes are used during printing of one page.

D. Internal Structure of Head Drive Circuit 52

Figure 12:
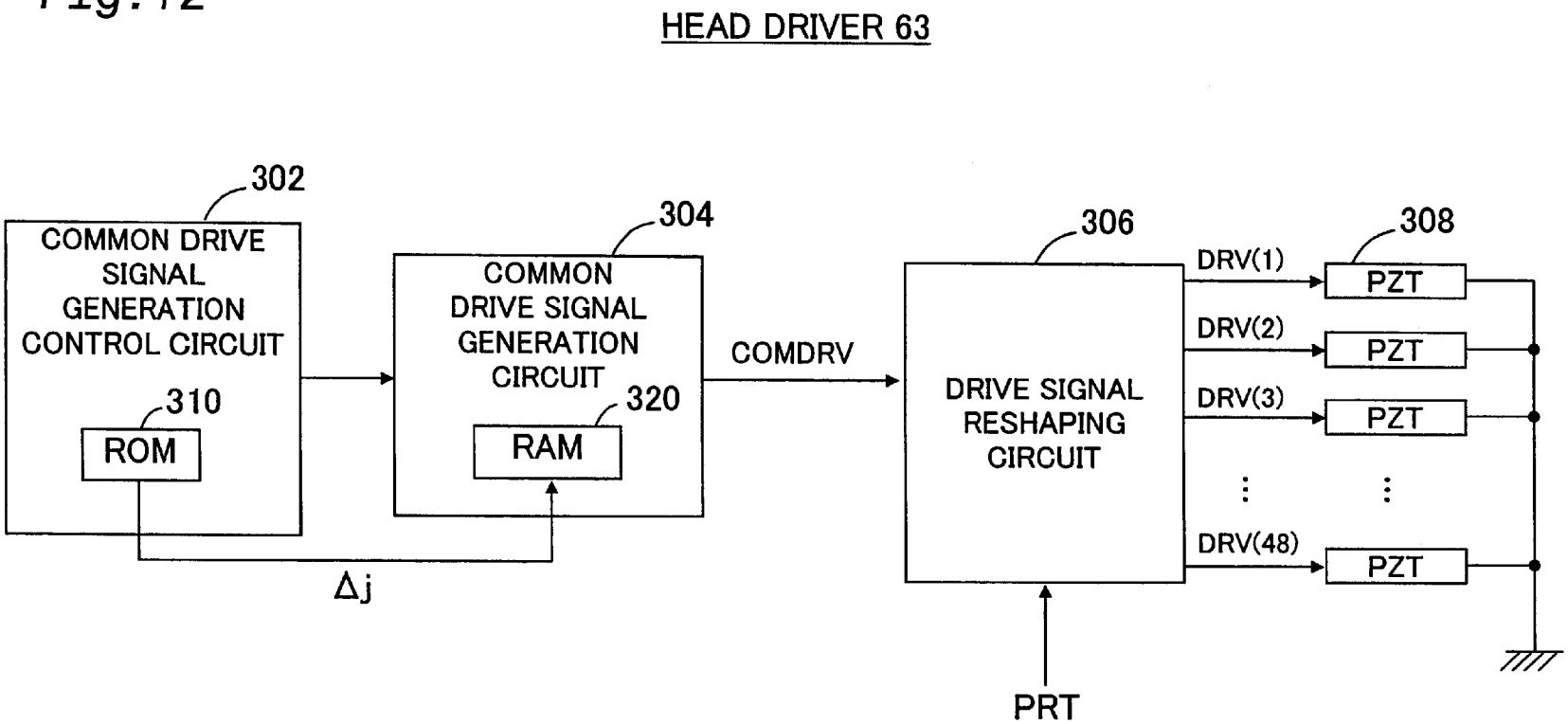
FIG. 12 is a block diagram depicting the internal structure of a head driver 63 (FIG. 2)

FIG. 12 is a block diagram depicting the internal structure of the head driver 63 (FIG. 2). The head driver 63 comprises a common drive signal generation control circuit 302, a common drive signal generation circuit 304, and a drive signal reshaping circuit 306.

The common drive signal generation circuit 304 has a RAM 320 for storing gradient values Δj that indicate a waveform slope of a common drive signal COMDRV, and generates a common drive signal COMDRV having any waveform with these gradient values Δj. The common drive signal generation control circuit 302 has a ROM 310 (or PROM) for storing a plurality of gradient values Δj for forward and reverse passes. In the drive signal reshaping circuit 306, the common drive signal COMDRV is partially or completely masked to produce a drive signal DRV in accordance with a serial print signal PRT fed from the computer 88 (FIG. 2), and the resultant signal is fed to the piezoelectric element 308 (drive element) of each nozzle.

Figure 13:
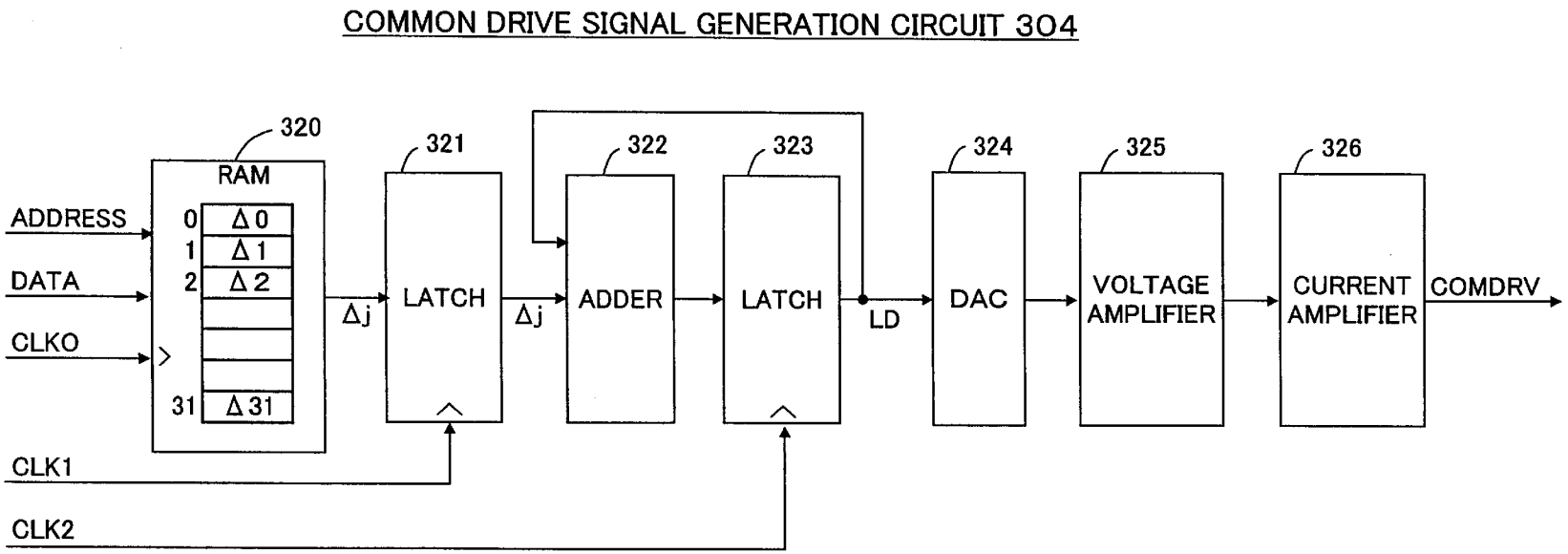
FIG. 13 is a block diagram depicting the internal structure of a common drive signal generation circuit 304.

FIG. 13 is a block diagram depicting the internal structure of the common drive signal generation circuit 304. The common drive signal generation circuit 304 comprises a first latching circuit 321, an adder 322, a second latching circuit 323, a D-A converter 324, a voltage amplifier 325, and a current amplifier 326 in addition to the RAM 320. These circuit elements are connected in series in the order indicated.

RAM 320 can store 32 gradient values (Δ0 to Δ31). At the time the gradient values Δj are written to the RAM 320, the data and addresses indicating the gradient values Δj are fed from the common drive signal generation control circuit 302 to the RAM 320 in synchronism with a clock pulse CLK0. When a gradient value Δj is to be read from the RAM 320, a read address is fed from the common drive signal generation control circuit 302 to the RAM 320. The gradient value Δj outputted from the RAM 320 is retained by the first latching circuit 321 in accordance with the pulse of the clock signal CLK1. The pulse of the clock signal CLK1 is generated every time a read address is fed to the RAM 320 and a gradient value Δj is outputted. Consequently, the first latching circuit 321 retains a new gradient value Δj every time there is a change in the gradient value Δj outputted from the RAM 320.

The second latching circuit 323 retains the output of the adder 322 for a given period in accordance with the constant-period pulse of a second clock signal CLK2. The adder 322 adds the gradient value Δj retained by the first latching circuit 321 and the previous addition result retained by the second latching circuit 323. The addition result is again retained by the second latching circuit 323 in accordance with the subsequent pulse of the second clock signal CLK2. Specifically, the adder 322 and the second latching circuit 323 function as accumulators for the gradual accumulation of gradient values Δj at regular periods. It is, however, not necessary to maintain a constant latching period for the second latching circuit 323, and a variable period may also be used. The output of the second latching circuit 323 will be referred to hereinbelow as "drive signal level data LD" or simply "level data LD." The drive signal level data LD are converted from digital to analog form by the D-A converter 324. The analog signal provided by the D-A converter 324 is amplified by the voltage amplifier 325 and the current amplifier 326, and a common drive signal COMDRV is generated as a result.

Figure 14:
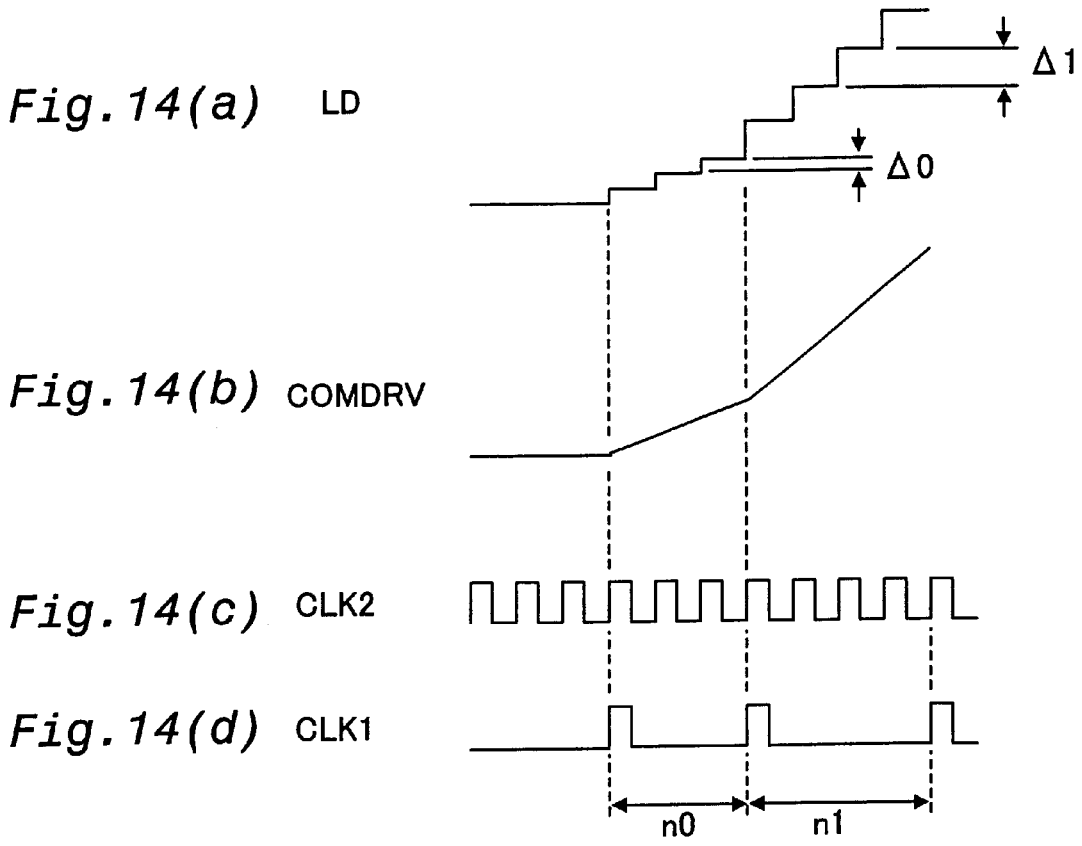
FIGS. 14(*a*)–14(*d*) are timing charts depicting the manner in which a common drive signal COMDRV is generated by the common drive signal generation circuit 304.

FIGS. 14(*a*)–14(*d*) are timing charts depicting the manner in which a common drive signal COMDRV is generated by the common drive signal generation circuit 304. First, a first gradient value Δ0 is read from the RAM 320, retained by the first latching circuit 321 in accordance with the pulse of the first clock signal CLK1, and inputted to the adder 322.

The first gradient value Δ0 is repeatedly added and level data LD are generated every time the rising edge of the second clock signal CLK2 is generated until the next read address is fed to the RAM 320. A second gradient value Δ1 is read from the RAM 320 when the subsequent read address is fed to the RAM 320, retained by the first latching circuit 321 in accordance with the clock pulse CLK1, and inputted to the adder 322. Specifically, the first clock signal CLK1 generates one pulse when the second clock signal CLK2 generates a predetermined number of pulses whose number is equal to that of the addition cycles nj (j=0–31) for the gradient value Δj. The common drive signal COMDRV can be kept horizontal by adopting zero as the gradient value Δj, and the level of the common drive signal COMDRV can be lowered by adopting a negative value for the gradient value Δj. Consequently, a common drive signal COMDRV having any waveform can be generated by setting the magnitude of the gradient value Δj and the corresponding number of addition cycles nj.

Figure 15:
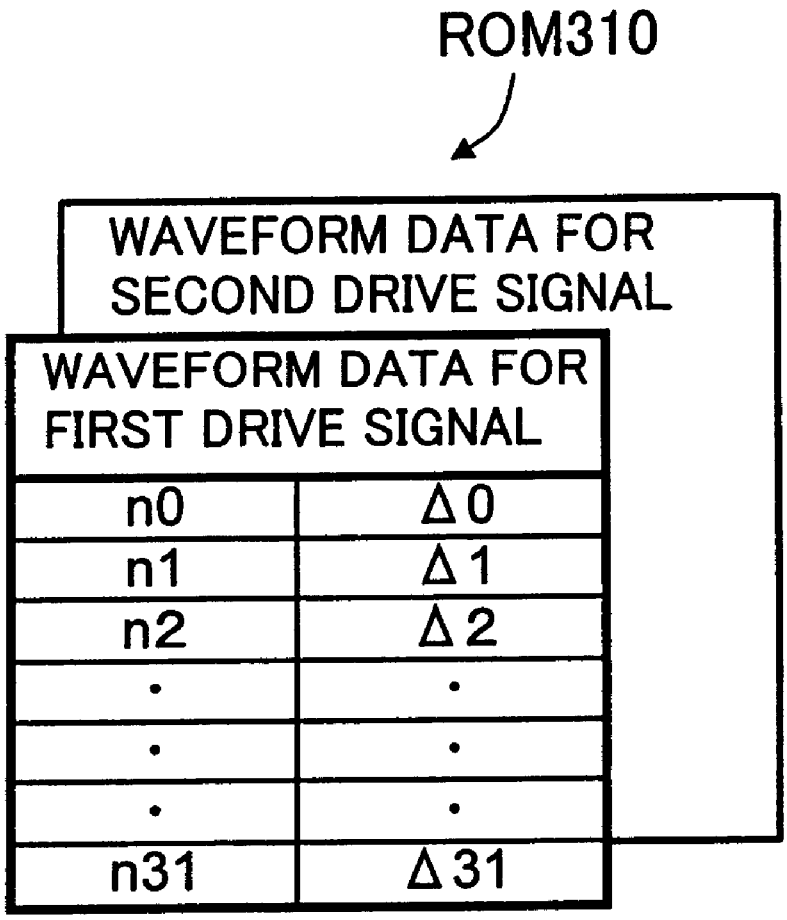
FIG. 15 is a diagram depicting the specifics of waveform data stored in the ROM 310 of a common drive signal generation control circuit 302.

FIG. 15 is a diagram depicting the specifics of waveform data stored in the ROM 310 of the common drive signal generation control circuit 302. Stored in the ROM 310 are waveform data related to multiple types of drive signal waveforms and composed of a plurality of gradient values Δj and the corresponding numbers of addition cycles nj. The common drive signal generation control circuit 302 writes the multiple gradient values Δj to be used in the subsequent forward or reverse pass to the RAM 320 in the common drive signal generation circuit 304 during an interval between forward and reverse main scan passes (that is, while the carriage 30 remains at either end of the printer 20 away from the printable area). The number of addition cycles nj is used when a read address and a first clock signal CLK1 are generated in the common drive signal generation control circuit 302. Using the common drive signal generation circuit 304 shown in FIGS. 12–15 makes it possible to selectively generate a common drive signal COMDRV out of a plurality of possible types of signals having arbitrary waveforms.

Figure 16:
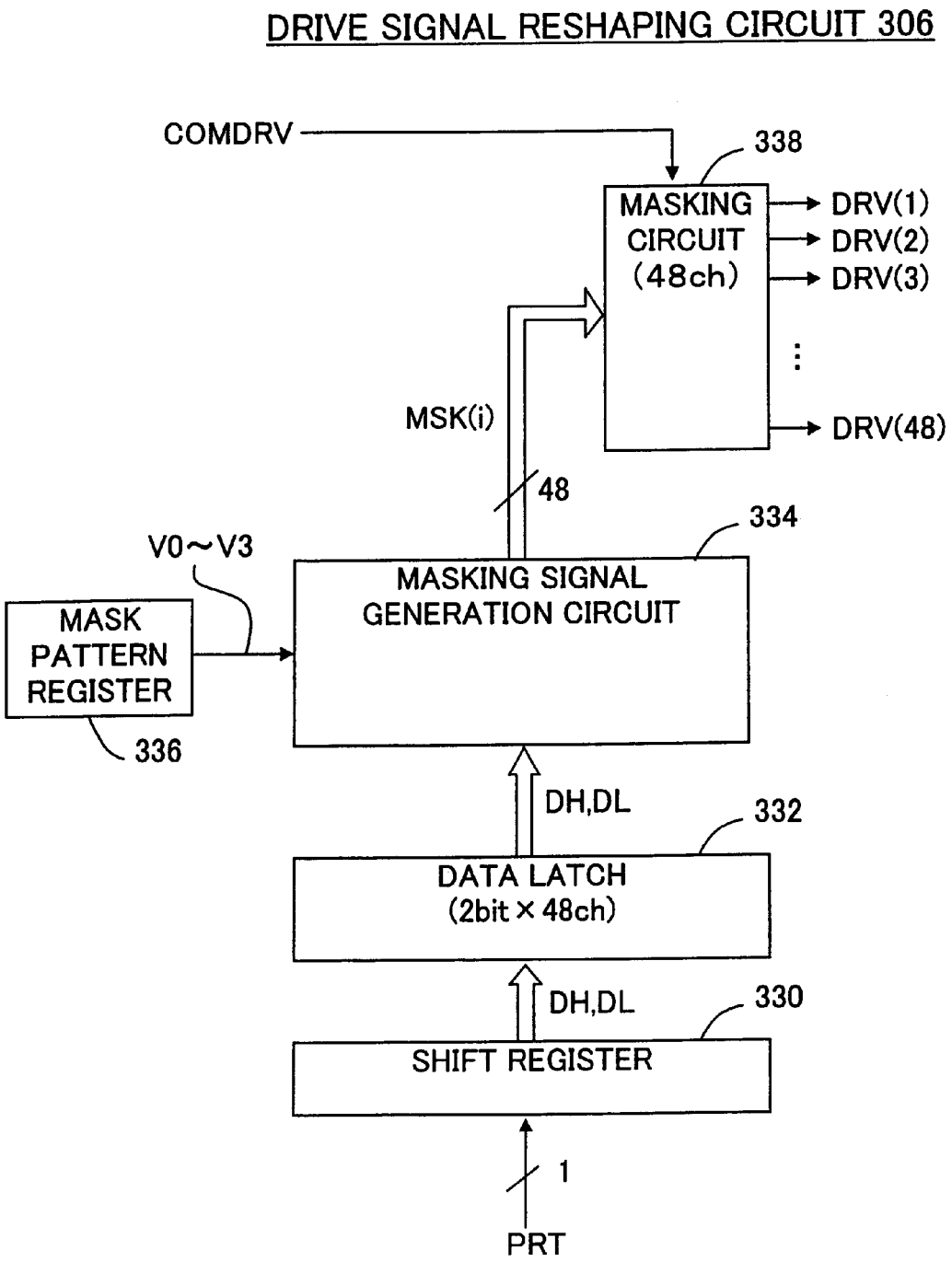
FIG. 16 is a block diagram depicting the internal structure of a drive signal reshaping circuit 306.

FIG. 16 is a block diagram depicting the internal structure of the drive signal reshaping circuit 306. The drive signal reshaping circuit 306 comprises a shift register 330, a data latch 332, a masking signal generation circuit 334, a mask pattern register 336, and a masking circuit 338. The shift register 330 converts the serial print signal PRT received from the computer 88 into parallel data (2 bits×48 channels). As used herein, the term "1 channel" refers to a signal corresponding to a single nozzle. A print signal PRT corresponding to a pixel for a single nozzle comprises two bits: a higher bit DH and a lower bit DL. The masking signal generation circuit 334 generates a single-bit masking signal MSK(i) (i=1–48) for each channel in accordance with the masking pattern data V0–V3 received from the mask pattern register 336 and the two-bit print signal PRT (DH, DL) specified for each channel. The masking circuit 338 is an analog switching circuit for partially or completely masking the signal waveform within a single pixel period of the common drive signal COMDRV in accordance with the masking signal MSK(i) received. As used herein, the term "masking a common drive signal" refers to connecting and disconnecting the signal line of the common drive signal COMDRV for a piezoelectric element.

E. Modifications

The present invention is not limited by the above-described working examples or embodiments and can be implemented in a variety of ways as long as the main features thereof are preserved. The following modifications are possible, for example.

E1. Modification 1

Although the above working examples are described with reference to the combined use of two common drive signals for multi-shot dots and variable dots, it is usually possible to print one page by employing any number n (where n is an integer of 2 or greater) of types of common drive signals. In such a case, an arrangement is preferably adopted such that an appropriate main scan speed is independently set for each common drive signal. Adopting a plurality of different values as main scan speeds allows various common drive signal waveforms to be used, making it possible to accomplish printing by employing a variety of dot series.

The common drive signals are not limited to those designed to reproduce each pixel with multi tones and may include those designed to reproduce each pixel in a binary tone (on/off). In this case, the print signal for masking a common drive signal is a binary signal. However, a common drive signal for reproducing each pixel with multi tones usually assumes a variety of waveforms to control the dot size. Consequently, the present invention is particularly effective when common drive signals that allow a plurality of pulses to be generated within a single pixel period are used in order to reproduce each pixel with multi tones.

E2. Modification 2

The present invention is also applicable to drum-scan printers. In a drum-scan printer, the direction of drum rotation is the main scanning direction, and the direction of carriage travel is the sub-scanning direction. In addition, the present invention is applicable not only to ink-jet printers but also to any printing device for recording images on the surface of a print medium with the aid of a print head having a plurality of nozzles. Examples of such printing devices include facsimile machines and copying machines.

E3. Modification 3

In the above working examples, software can be used instead of some of the structures implemented in the form of hardware, and, conversely, hardware can be used to carry out some of the functions performed by software. For example, the functions of the control circuit 40 (FIG. 2) can be partially performed by a host computer 88.

The computer program for executing such functions can be supplied as data stored on a floppy disk, CD-ROM, or other computer-readable recording medium. The host computer reads the computer program from the recording medium and transfers the program to an internal or external storage device. Alternatively, the computer program can be loaded into the host computer from a program supply device via a transmission line. When stored by an internal storage device, the computer program can be executed by the microprocessor of the host computer to perform the functions of the computer program. The computer program stored on a recording medium may be directly executed by the host computer.

As used herein, the term "host computer" is a general term that includes an operating system and hardware equipment, and refers to hardware equipment operating under the control of the operating system. Computer programs allow such a host computer to perform the functions of the above-described units. Some of the above-described functions can be performed by an operating system rather than an application program.

As used herein, the term "computer-readable medium" is not limited to a portable recording medium such as a floppy disk or a CD-ROM and includes various types of RAM, ROM, and other internal storage devices mounted in computers, or hard drives and other external storage devices attached to the computers.

INDUSTRIAL APPLICABILITY

The present invention can be adapted to printers, facsimile machines, and other devices for discharging ink from nozzles.

What is claimed is:

1. A printing device for printing images on a print medium while performing a main scan, comprising:

a print head having a plurality of nozzles and a plurality of discharge drive elements for causing the plurality of nozzles to discharge ink droplets from;

a main scan drive for performing bi-directional main scanning by moving at least one of the print medium and the print head;

a sub-scan drive for performing sub-scanning by moving at least one of the print medium and the print head;

a head drive for supplying drive signals to the discharge drive elements in accordance with print signals; and a controller for controlling printing operation, the head drive comprising:

a common drive signal generator capable of selectively generating one of n types of common drive signals for each main scan where n is an integer of 2 or greater;

a drive signal reshaping circuit for reshaping the common drive signal supplied from the common drive signal generator with respect to each pixel in accordance with the print signals, thereby generating the drive signals to be supplied to the discharge drive elements; and a recording position adjustment section for adjusting recording positions in the main scanning direction by employing positional difference adjustment values prepared in advance in order to reduce a difference between the recording positions in the main scanning direction, the positional difference adjustment values being prepared for combinations of common drive signals that are usable within one page of the print medium and that are selected from all possible combinations of common drive signals suitable for use in a forward main scanning pass and common drive signals suitable for use in a reverse main scanning pass.

2. A printing device as defined in claim 1, wherein the positional difference adjustment values include at least either of bi-directional adjustment values for use during bi-directional printing and unidirectional adjustment values for use during unidirectional printing.

3. A printing device as defined in claim 1, wherein when the main scan is performed using at least one specific common drive signal selected from the n types of common drive signals, the main scan drive performs a main scan at a main scan speed different from a speed at which the main scan is performed using other common drive signals.

4. A printing device as defined in claim 1, wherein the print head can form multiple types of dots of different sizes on the print medium with the nozzles;

the print signals are signals with a plurality of bits per pixel that are used for recording each pixel with multi tones;

each of the n types of common drive signals generates a plurality of pulses during one pixel period; and the drive signal reshaping circuit reshapes the common drive signal in accordance with the multi-bit print signals.

5. A method for printing images by employing a print device comprising a print head having a plurality of nozzles and a plurality of discharge drive elements for causing the plurality of nozzles to discharge ink droplets, and a head drive for reshaping a common drive signal and feeding drive signals to the discharge drive elements in accordance with print signals, the method comprising the steps of:

(a) selecting one of n types of common drive signals for each main scan where n is an integer of 2 or greater;

(b) reshaping the common drive signal supplied from the common drive signal generator with respect to each pixel in accordance with the print signals, thereby generating the drive signals to be supplied to the discharge drive elements; and (c) adjusting recording positions in the main scanning direction by employing positional difference adjustment values prepared in advance in order to reduce a difference between the recording positions in the main scanning direction, the positional difference adjustment values being prepared for combinations of common drive signals that are usable within one page of the print medium and that are selected from all possible combinations of common drive signals suitable for use in a forward main scanning pass and common drive signals suitable for use in a reverse main scanning pass.

6. A printing method as defined in claim 5, wherein the positional difference adjustment values include at least either of bi-directional adjustment values for use during bi-directional printing and unidirectional adjustment values for use during unidirectional printing.

7. A printing method as defined in claim 5, wherein the step (c) includes a step of, when the main scan is performed using at least one specific common drive signal selected from the n types of common drive signals, performing a main scan at a main scan speed different from a speed at which the main scan is performed using other common drive signals.

8. A printing method as defined in claim 5, wherein the print head can form multiple types of dots of different sizes on the print medium with the nozzles;

the print signals are signals with a plurality of bits per pixel that are used for recording each pixel with multi tones;

each of the n types of common drive signals generates a plurality of pulses during one pixel period; and the step (c) includes a step of reshaping the common drive signal in accordance with the multi-bit print signals.

9. A computer program product for causing a computer to perform printing, the computer comprising a print device including a print head having a plurality of nozzles and a plurality of discharge drive elements for causing the plurality of nozzles to discharge ink droplets, and a head drive for reshaping a common drive signal and feeding drive signals to the discharge drive elements in accordance with print signals, wherein the computer program product comprises:

a computer-readable medium; and a computer program stored on the computer-readable medium; the computer program comprising:

a first program for selecting one of n types of common drive signals for each main scan where n is an integer of 2 or greater;

a second program for reshaping the common drive signal supplied from the common drive signal generator with respect to each pixel in accordance with the print signals, thereby generating the drive signals to be supplied to the discharge drive elements; and a third program for adjusting recording positions in the main scanning direction by employing positional difference adjustment values prepared in advance in order to reduce a difference between the recording positions in the main scanning direction, the positional difference adjustment values being prepared for combinations of common drive signals that are usable within one page of the print medium and that are selected from all possible combinations of common drive signals suitable for use in a forward main scanning pass and common drive signals suitable for use in a reverse main scanning pass.

10. A computer program product as defined in claim 9, wherein the positional difference adjustment values include at least either of bi-directional adjustment values for use during bi-directional printing and unidirectional adjustment values for use during unidirectional printing.

11. A computer program product as defined in claim 9, wherein the third program includes a program for, when the main scan is performed using at least one specific common drive signal selected from the n types of common drive signals, performing a main scan at a main scan speed different from a speed at which the main scan is performed using other common drive signals.

12. A computer program product as defined in claim 9, wherein the print head can form multiple types of dots of different sizes on the print medium with the nozzles;

the print signals are signals with a plurality of bits per pixel that are used for recording each pixel with multi tones;

each of the n types of common drive signals generates a plurality of pulses during one pixel period; and the third program includes a program for reshaping the common drive signal in accordance with the multi-bit print signals.

* * * * *